US006659617B1

(12) United States Patent
Michael

(10) Patent No.: US 6,659,617 B1
(45) Date of Patent: Dec. 9, 2003

(54) ILLUMINATED JEWELERY

(75) Inventor: Peter Michael, Berkshire (GB)

(73) Assignee: Scintillate Limited, London (GB)

( * ) Notice: Subject to any disclaimer, the term of this patent is extended or adjusted under 35 U.S.C. 154(b) by 0 days.

(21) Appl. No.: 10/009,617

(22) PCT Filed: May 11, 2000

(86) PCT No.: PCT/GB00/01803

§ 371 (c)(1),
(2), (4) Date: Nov. 7, 2001

(87) PCT Pub. No.: WO00/69304

PCT Pub. Date: Nov. 23, 2000

(30) Foreign Application Priority Data

May 12, 1999 (GB) ..... 9911045

(51) Int. Cl.[7] ..... F21V 21/08
(52) U.S. Cl. ..... 362/104; 362/571; 315/76
(58) Field of Search ..... 362/103, 104, 362/571, 800; 315/76, 200 A, 291, 307, 362

(56) References Cited

U.S. PATENT DOCUMENTS 3,875,456 A 4/1975 Kano et al.
4,936,116 A * 6/1990 Poll ..... 63/28
4,973,835 A 11/1990 Kurosu et al.
5,201,578 A * 4/1993 Westmoland ..... 362/104
5,323,300 A * 6/1994 McCrary ..... 362/571
5,477,433 A * 12/1995 Ohlund ..... 362/104
6,433,483 B1 * 8/2002 Michael et al. ..... 315/76

FOREIGN PATENT DOCUMENTS

| | | |
|---|---|---|
| CH | 593 649 A | 12/1977 |
| EP | 0 745 339 A1 | 12/1996 |
| FR | 960494 A | 4/1950 |
| GB | 1 352 835 A | 5/1974 |
| WO | WO 94/01854 | 1/1994 |
| WO | WO 00/69304 | 11/2000 |

* cited by examiner

*Primary Examiner*—Sandra O'Shea
*Assistant Examiner*—John Anthony Ward
(74) *Attorney, Agent, or Firm*—Dinsmore & Shohl LLP

(57) ABSTRACT

An article of jewelery (10; 110) for generating an attractive composite optical effect, is described. The article (10; 110) comprises a compound jewel (12; 112), such as a "Precious Jewel set within a Silver Sea", having a first and a second portion (14, 16; 114, 116) with different optical properties and a light source, such as a coloured LEDs package (30; 122), incorporated in the article of jewellery (10; 110) for at least illuminating the first portion (14; 114) of the compound jewel (12; 112). The compound jewel (12; 112) and the light source (30; 122) are arranged to generate the composite optical effect from the artificially illuminated first portion (14; 114) and from the second portion (16; 116) when the same is naturally or artificially illuminated. Artificial illumination of the second portion (16; 116) can be provided by a further coloured LEDs package (32) incorporated in the article of jewellery (10; 110).

31 Claims, 5 Drawing Sheets

ILLUMINATED JEWELERY

The present invention concerns improvements relating to illuminated jewellery, and more specifically, relates to a method of and an article of jewellery for generating attractive compound optical effects. More particularly, though not exclusively, the optical effects can simulate naturally occurring optical effects such as sparkle and scintillation or can generate artificial optical effects such as ripple and pulsed lighting.

BACKGROUND

A jewel stone is an optical system that is manufactured from material that is not opaque to light. It may be a natural mineral or a manufactured artificial mineral or optical compound. The design is such that when illuminated and viewed from the front the light falling upon it is largely refracted, internally reflected and returned to the front so that the jewel stone appears bright. The refraction and reflection process may also change the colour of the light emitted after passing through the jewel stone and re-emerging. Jewellery including one or more jewel stones is generally designed so that it does not pass light from the front to the rear. Thus when illuminated from the front and viewed from the rear, the jewel stones appear dull.

The process of design and manufacture of jewellery often involves cutting the mineral into carefully designed angles and facets that are intended to achieve the desired optical effects of causing the front surface to sparkle or scintillate as the refraction and reflection occurs. Such optical effects occur when the jewel stones catch external light at certain incident angles and reflect or diffuse the light.

Scintillation is the word generally associated with jewellery that sparkles. The scintillation effect is most pronounced when correctly designed jewels are illuminated with a point source such as a candle and the jewel is moved through some angular rotation. Very small angular movements can provide substantial scintillation by virtue of the multiple internal reflections refractions and dispersions which are given words such as fire and brilliance.

Although jewel stones are generally designed to have optical effect, when external light is not strong enough, little optical effect including scintillation effect occurs and the colours of the jewel stones are not readily visible. Further, when there is no relative movement between jewellery, the viewer and external light, jewel stones do not produce any optical effect even if enough ambient light is present.

Artificial illumination of a jewel in an article of jewellery has previously been described in our co-pending International patent application WO-A-99/23906. The jewel of a known cut, e.g. a brilliant cut, is artificially illuminated in such a way as to simulate realistic optimum natural illumination. This type of illumination generates simulated natural optical effects in the jewel such as sparkle, scintillation and glow. This is achieved by a jewel of the article of jewellery being illuminated by light emitting diodes (LEDs) and the article including a digital controller for controlling the LEDs to emit light pulses which are variable in duration and intensity. The pattern of light pulses emitted from the LEDs illuminating the jewel can be varied to simulate the natural optical effects.

An object of the present invention is to provide improvements to the concepts described in the above International patent application.

SUMMARY OF THE INVENTION

The present inventors have devised a novel jewellery structure which when illuminated can provide enhanced optical effects that are highly attractive. In its broadest aspect, the present invention resides in an article of jewellery comprising an artificially illuminated compound jewel. In particular, improved optical effects are generated as a result of the interaction between the optical effects of each of the component parts of the compound jewel when at least one of those component parts is artificially illuminated.

Preferably at least two of the component parts are illuminated so that despite the external lighting conditions, the optical interaction effects between the at least two component parts can be produced.

According to a more specific aspect of the present invention, there is provided an article of jewellery for generating an attractive composite optical effect, the article of jewellery comprising: a compound jewel having first and second portions with different optical properties; and a light source for artificially illuminating at least the first portion of the compound jewel, the compound jewel and light source being arranged to generate the composite optical effect from the artificially illuminated first portion and from the second portion when the same is naturally or artificially illuminated.

The present invention may also be considered to be an article of jewellery arranged to simulate natural optical effects or create enhanced visual effects, the article comprising a compound jewel and a light source incorporated in the article of jewellery for emitting light so as to illuminate at least a part of the compound jewel.

A compound jewel, as referred to hereinafter, is to be understood to be at least one jewel mounted within another larger jewel. Accordingly, a compound jewel has at least two different components each having its own set of optical properties. These sets of optical properties are different from each other due to the inherent difference in physical size of the components. However, the sets of optical properties can be selected to have different light-transmission characteristics and different reflectance and refraction properties by the use of different materials for each component. The components are selected to give a desired visual output due to the combined optical effects generated when at least one of the jewels (components) is illuminated.

The term 'jewel' is to be construed broadly throughout this description to mean any article or material having optical reflective and/or refractive properties. Examples of such jewels are one or more precious stones such as diamonds or rubies, semi-precious stones, imitations of these stones made from artificial materials or even small reflective metallic objects. These jewels may be combined aesthetically as desired.

Generally, the compound jewel can be mounted to an attractive metal support that has formations provided on it enabling it to be suspended as in the case of a necklace or pinned as in the case of a brooch.

One or more of the jewels are illuminated by light sources incorporated in the article of jewellery. In an embodiment of the present invention, the illumination is by way of light pulses that are variable in intensity and duration in a similar manner to that described in the above-mentioned co-pending International patent application. Using a digital controller, the light pulses can be generated under the control of a software program to produce the desired optical output.

Preferably, the or each light source comprises a set of miniature coloured LEDs. If a red LED, a green LED and a blue LED are used, then advantageously each light source can produce any desired colour output dependant on the way in which the LEDs are driven, namely by controlling the amounts of light produced from each coloured LED.

Advantageously, it becomes possible to contrast the illumination of one jewel (component) with that of the other and an improved range of visual effects can easily be generated.

Preferably, a two-component compound jewel is provided with two different independently controllable light sources. Each component of the compound jewel can be illuminated in a different colour to provide desired contrasting optical effects. The illumination colours and intensities can be varied over time advantageously to obtain a continually changing attractive visual effect.

More specifically, the first jewel, can be a so called "Precious Jewel" (PJ) and is the smaller stone of the two. The PJ may comprise any material with suitable optical properties from quartz to diamond and is usually cut in any way that produces attractive light refraction and reflection.

The second jewel can be a larger and generally plainer "jewel" which is designated a "Silver Sea" (SS). The SS may comprise a material that is of a lower cost than the PJ. For example, the SS may comprise any of a large number of natural or artificial quartz materials sometimes with deliberate inclusions for effect. The SS is prepared by a quartz material stone being shaped and polished to give any one of a number of attractive and suitable finishes.

In this arrangement, the compound jewel is made by cutting a hole in the front face of the SS and mounting the PJ together with its associated illuminating LEDs within this hole. Thus creating a "Precious Jewel set in a Silver Sea". The hole can be central to the SS or alternatively, it can be off-centre depending upon the particular aesthetic design of the jewellery.

In one practical implementation, the illumination of the SS is arranged to be complimentary to the PJ. For example, the SS may be illuminated in white light and the PJ illuminated in blue light. By digital control of the respective LEDs, the colours and intensities may, over time, be varied to maintain a continuously changing attractive visual effect. Generally, both the SS and the PJ have their own independent illuminating LEDs suitable digitally controlled although it is not fundamental to the present invention and the compound jewel may be illuminated by a single LED source to produce a limited range of colours and contrasts.

It is possible to provide a compound jewel with three or more components. In this case, two or more relatively small jewels can be provided within a relatively larger jewel. Also each jewel can carry its own respective illumination source with all of the different light sources being under the control of a low-power PIC microprocessor for example.

A digital program may be stored in the illumination controller for allowing the apparent transmutation of the PJ and the SS into other jewels having different optical characteristics. The program can control the individual coloured LEDs of the light sources such that outputs from these different coloured LEDs may be combined to create broadly any colour at any intensity. By mixing the outputs of the LEDs, different colours of illumination can advantageously be created and used to give the appearance that the type of PJ or SS in the article has been changed. This provides the user with the ability to change the appearance of his or her jewellery without having to change the article of jewellery itself.

The desired colour range of one of the jewels may be selected from a sequential series by use of touch pads on the article of jewellery. This advantageously enables the article to be miniaturised whilst still retaining adaptability. Once the desired colour range for the jewel has been reached the program can deliver various intensities over time within the selected colour range.

Preferably, the power supply is from a single ultra-low voltage battery, such as 1.2 Volts and the power supply circuit of the article of jewellery is arranged to step up this low voltage to a level (typically 3.0 Volts) which is suitable to drive the light source and an illumination controller, such as the PIC microcontroller. In an embodiment of the present invention, the voltage is stepped up under the control of a microelectronic switching power supply.

As the battery cells typically are have the largest volume of any of the components and weigh the most out of any of the components, this improvement allows the jewellery design to be fabricated in a small volume with a lower weight. This improvement enables the article of jewellery to be realised in a small compact package for example as in a cube with dimensions of 12 mm.

The present invention also extends to a method of generating an attractive composite optical effect in an article of jewellery comprising a compound jewel with first and second portions having different optical properties, the method comprising: artificially illuminating a first portion of the compound jewel; and artificially or naturally illuminating a second portion of the compound jewel, the combined effect of the illumination of both portions providing the composite optical effect.

The step of artificially or naturally illuminating a second portion of the compound jewel may comprise artificially illuminating the second portion independently of the first portion to provide different illumination of the first and second portions.

DETAILED DESCRIPTION

Preferred embodiments of the present invention will now be described by way of example with reference to the accompanying drawings.

Figure 1A:
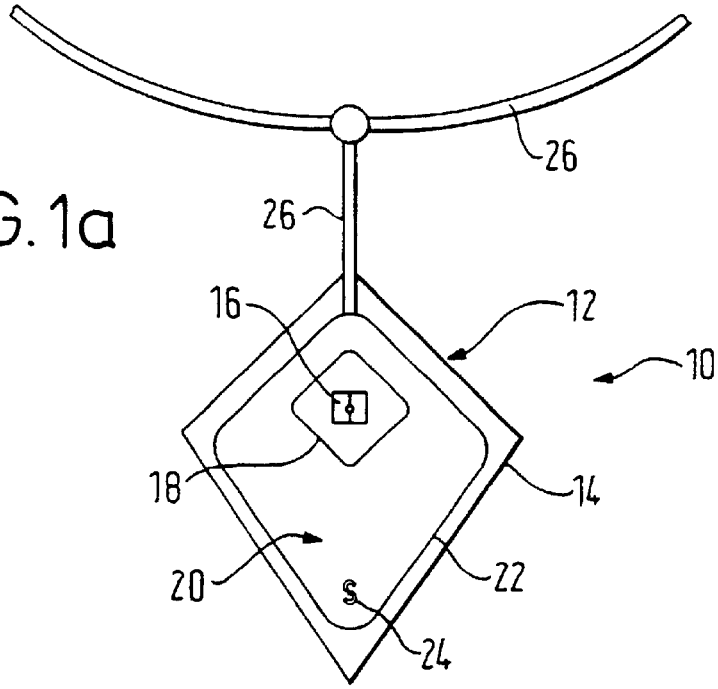
FIG. 1*a* is a front view of an article of jewellery incorporating a compound jewel of a first embodiment of the present invention.

Referring now to FIG. 1*a*, an article of jewellery 10 is shown according to a first embodiment of the present invention. The article of jewellery 10 comprises a compound jewel 12 which is made up of two jewels; a relatively large jewel 14 and a smaller jewel 16 mounted within the large jewel 14. The large jewel 14 has a square-shaped hole 18 cut out of its front face 20 in which the small jewel 16 is placed and mounted. An electronic control circuit is provided on the rear face 21 of the large jewel 14 and is protected by a metal housing 22. The physical arrangement of the rear face 21 is described later with reference to FIG. 1*b*.

The front face 20 of the compound jewel 12 has a pair of touch-sensitive electrical contacts 24 provided therein as part of the aesthetic design of the article 10. The miniature metallic contacts 24 are provided for inputting basic user instructions into the electronic control circuit (See FIG. 1*b*) and these instructions are responsible for the selection of the particular illumination of the article 10. Each contact 24 has a semicircular shape and together they make up an 'S'-shaped touch-sensitive switch. The contacts are formed by an 'S'-shaped groove being cut out in the front face 20 of the large jewel 14 and metal being is set into the groove. Each of the contacts 24 is wired to the electronic control circuit which can sense when a finger covers the contacts 24. It does this by sensing the change of resistance when a weak conductive link is formed between the contacts by the user's finger.

The article 10 is suspended from a chain 26 such that it can be worn as a pendant. A formation 28 (see FIG. 1*b*) in the metal housing 22 is provided at the rear face 21 of the article. This formation 28 enables the connection of the chain 26 to the article 10.

The small jewel 16 is embedded within the large jewel 14. The small jewel 16 has a diameter of approximately 5 mm and is a so called "Precious Jewel" (PJ) 16. In this embodiment, the PJ 16 is made from a high-quality quartz material shaped in a brilliant cut that produces sharp attractive light refraction and reflection. However, the PJ 16 can be formed from another material such as diamond and can also be cut in other different jewel cuts.

The large jewel 14 has a diameter of approximately 25 mm and has plainer (duller) more diffuse optical characteristics than the small jewel 16. In this way, the two jewels 14, 16 have contrasting optical characteristics. The large jewel 14 is referred to as a "Silver Sea" (SS) 14. In this embodiment, the SS 14 is formed from a lower-cost quartz material than the material of the PJ 16. The SS 14 is prepared by the quartz material stone being shaped and polished to give an attractive finish.

Figure 1B:
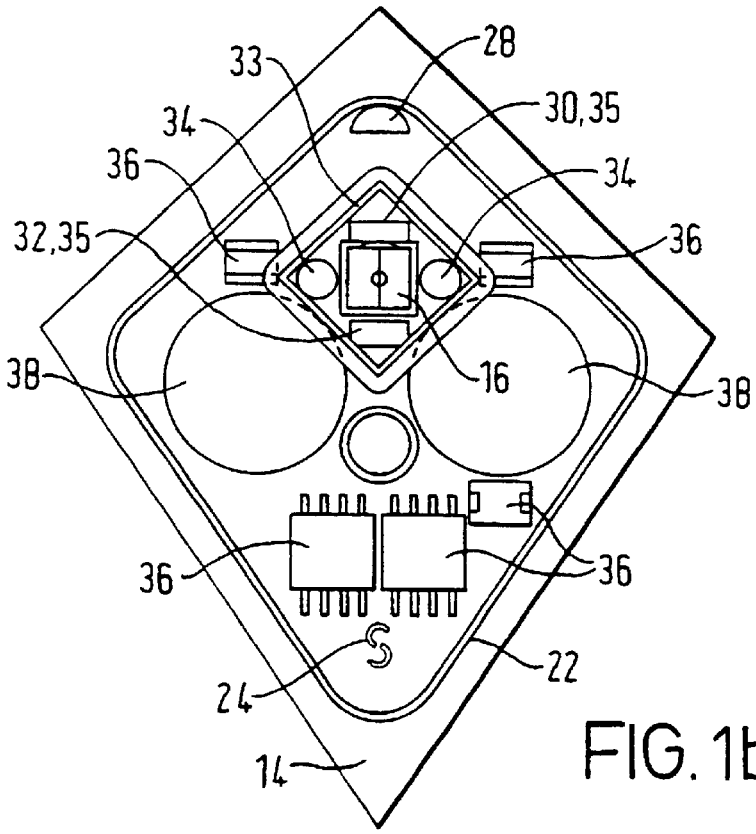
FIG. 1*b* is a rear view the article of jewellery of FIG. 1 with its metal cover removed and showing the electronic components of its illumination system.

Referring now to FIG. 1*b*, the physical layout of the components on the rear face 21 of the article 10 is shown. The article 10 comprises an illumination system for illuminating both the small and the large jewels 16, 14 of the compound jewel 12. In particular, a first multiple-colour LED package 30 is provided for illuminating the small jewel 16, and a second multiple-colour LED package 32 for illuminating the large jewel 14. Each LED package 30, 32 generates selectable multiple-coloured light output from a group of three LEDs 34 (one red, one green and one blue) provided adjacent each other in the package.

Each LED package 30, 32 is individually wired to the electronic control circuit which can control the light output in terms of its intensity, duration, colour and frequency. This is achieved by the electronic control circuit comprising a PIC microprocessor which generates variable intensity digital drive pulses in a way that has been previously described in our co-pending International patent application WO-A-99/23906. It is to be appreciated that the contents of this International patent application are incorporated herein by reference. The positions of the components 36 which form part of the electronic control circuit are illustrated in FIG. 1*b*.

The power supply for the PIC microprocessor is provided by two Nickel Metal Hydride rechargeable batteries 38. The power is regulated at 3.0 Volts by a voltage regulator device 36.

As mentioned above, the compound jewel 12 is formed by cutting out the square-shaped hole 18 in the front face 20 of the SS 14 and mounting the PJ 16 together with the illuminating LED packages 30, 32 within this hole 18. The PJ 16 and the LED packages 30, 32 are integrated into a single assembly 33 which slots into the hole 18 and is secured in place by two mounting screws 34 which are not visible on the front face 20 of the article 10. In this embodiment, the hole 18 is positioned to be off centre to the SS 14. However, in other embodiments, the hole 18 can be positioned centrally to give a different aesthetic design.

The electrical connection to each of the LED packages 30, 32 is achieved using flying leads (not shown) to the electronic control circuit. However, this could readily be substituted by fixed leads to internal contact points in the hole 18 with complimentary contacts provided on the assembly 33, such that when the assembly is correctly seated in the hole 18, power and control signals can be supplied to the LED packages 30, 32 via the contacts.

The two LED packages 30, 32 can be controlled independently of each other and are arranged to provide contrasting illumination of the compound jewel 12. Accordingly, when appropriately illuminated, the article of jewellery 10 presents an optical image which can be described as a "Precious Jewel set in a Silver Sea".

A digital program is stored in the PIC microprocessor for allowing the apparent transmutation of the PJ 16 and the SS 14 into other jewels having different optical characteristics. The program controls the individual red, green and blue LEDs 35 of the first and second LED packages 30, 32. Outputs from these different coloured LEDs 35 may be combined to create broadly any colour at any intensity. By mixing the outputs of the LEDs packages, different colours of illumination can be created and used to give the appearance that the type of PJ 16 or SS 14 in the article 10 has changed. For example, illumination by white light would resemble the appearance of artificial diamonds, pink light would give the appearance of amethyst, golden/orange light would give the appearance of topaz, with blue light simulating the appearance of sapphire, green light simulating the appearance of emeralds, etc. Therefore, natural optical effects seen in a particular colour jewel can be simulated by first determining a range of illumination for the jewel and then generating artificial illumination variations within the selected colour range.

Various simple means of controlling and selecting the colour range can be used. In the present embodiment, the colour range of the PJ 16 is selected from a sequential series by placing a finger on the surface of the SS 14 where the miniature S-shaped metallic contacts 24 are provided. The program running on the PIC microprocessor cycles through the different colours until the user's finger is removed from the contacts 24. This enables the desired colour range for the PJ 16 to be reached. The program then continues cyclically to deliver various intensities over time within the selected colour range.

The above procedure can be repeated for setting the illumination colour range of the SS 14. For the most dramatic effects, the colour range of the SS 14 is selected to be in contrast to the illumination of the PJ 16.

Figure 1C:
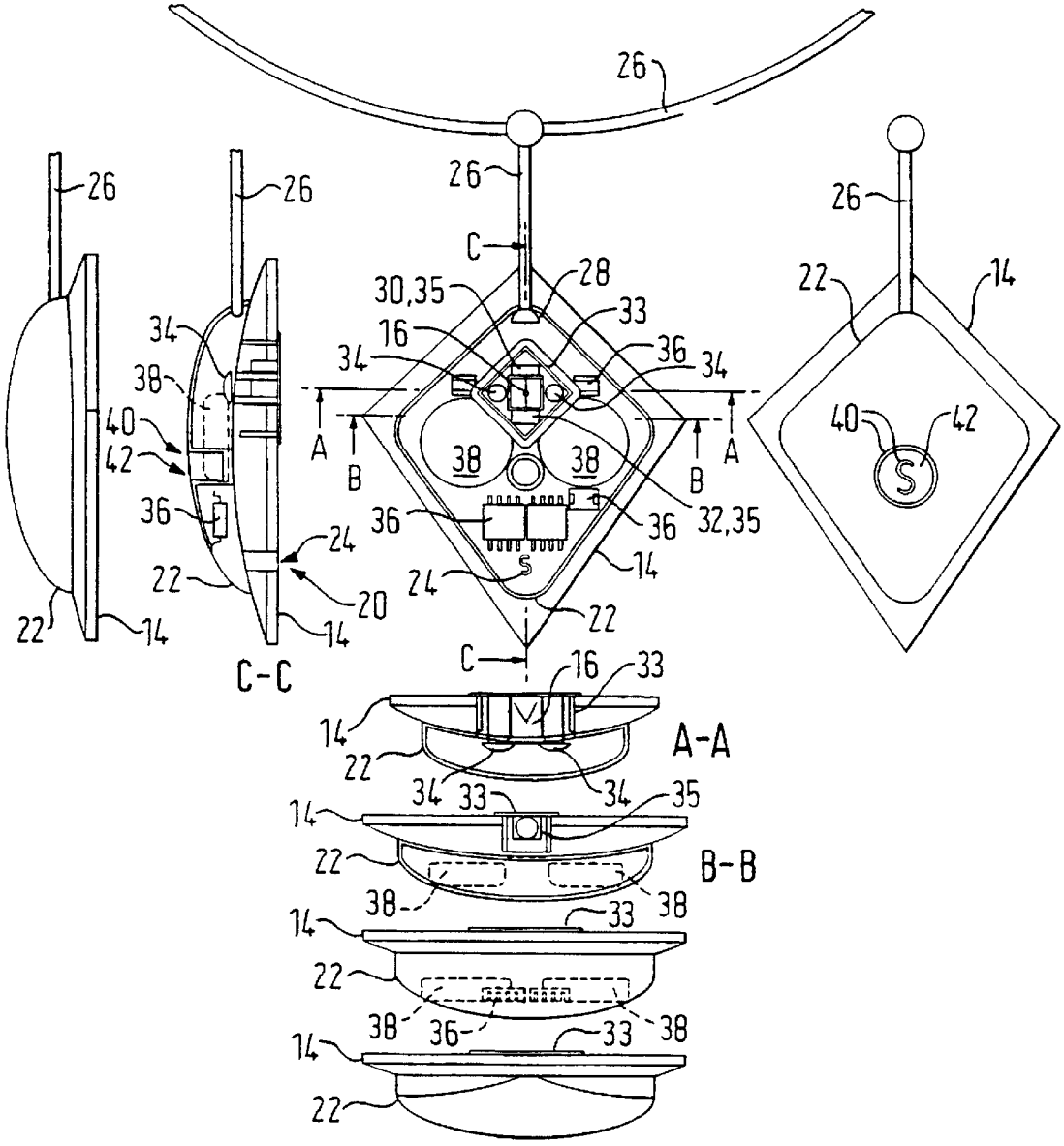
FIG. 1*c* is a series of sectional and non-sectional, side and rear views of the article of jewellery of FIGS. 1*a* and 1*b;*

Referring now to FIG. 1*c*, as can be best seen in the rear view of the assembled article 10, the article 10 has a pair of charging terminals 40 for connection to a charging stand (not shown). The charging terminals 40 are arranged in novel and an aesthetically attractive manner. In particular, the charging terminals 40 are provided as part of a fixing screw 42 which is used to secure the metal housing 22 of the article 10 to the rear surface of the large jewel 14. The provision of a recharging facility allows a user to recharge the batteries 24 after a session of wearing and using the article 10.

Figure 2:
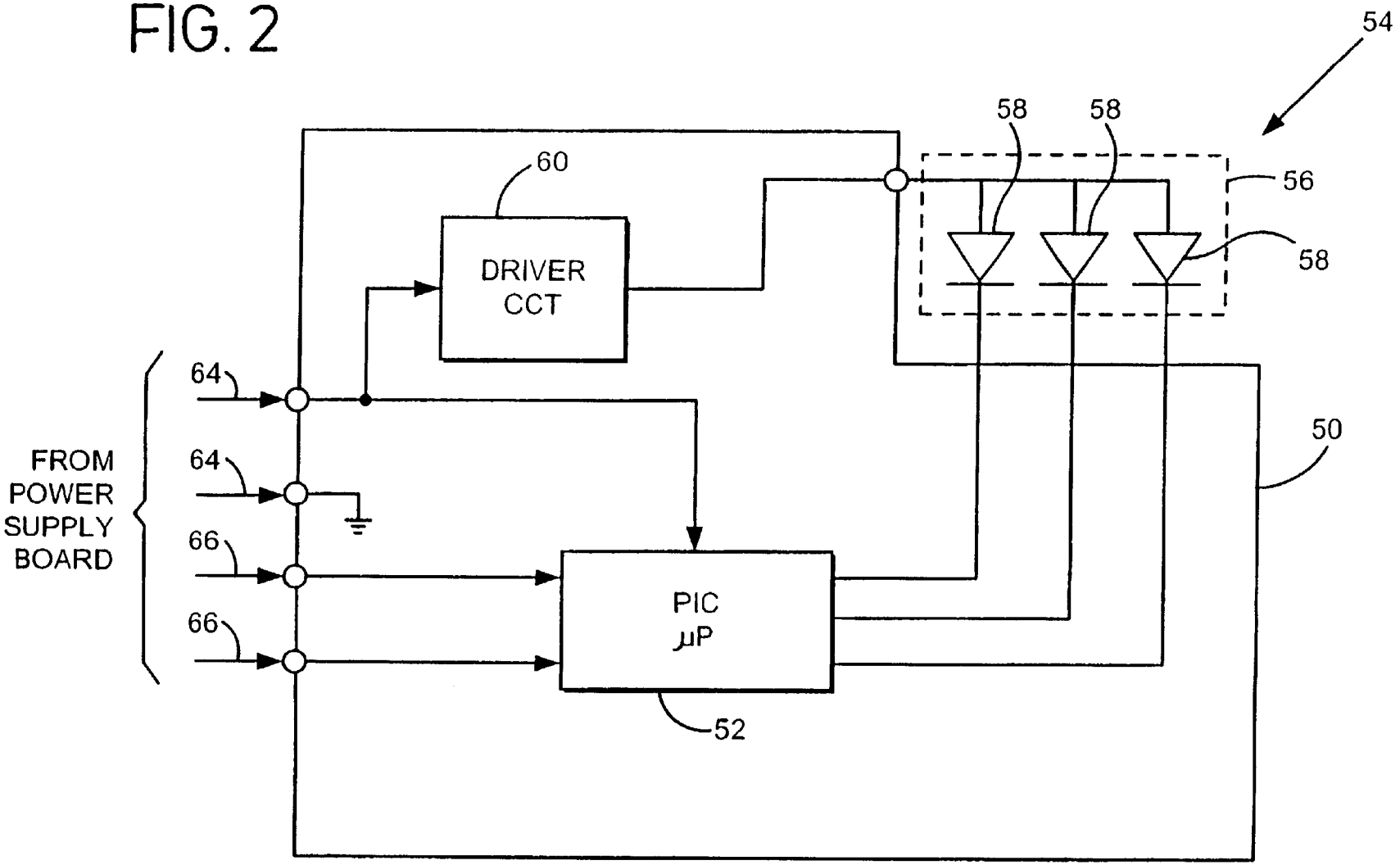
FIG. 2 is a block diagram of a PIC microprocessor board and an LED light source of the illumination system used in a second embodiment of the present invention.
Figure 3:
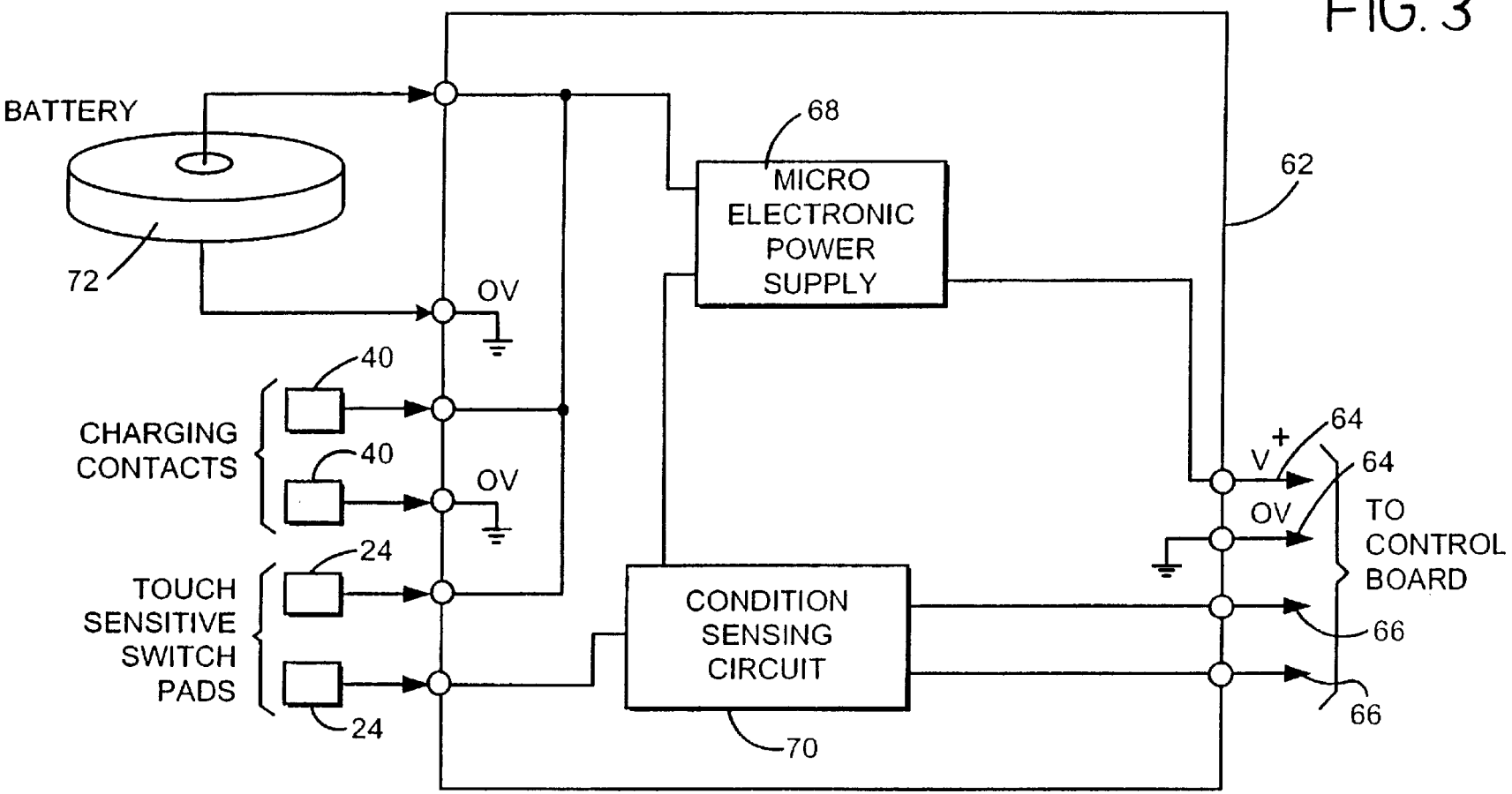
FIG. 3 is a block diagram of a power supply board of the illumination system used in the second embodiment of the present invention.

Referring now to FIGS. 2 and 3, a second embodiment of the present invention is shown. This embodiment is similar to the first embodiment and so only the differences will be described hereinafter. In addition, the same reference numerals will be used for corresponding parts of the embodiments.

The main differences between the embodiments are that in this embodiment, only the small jewel 16 of the compound jewel 12 is artificially illuminated by the provision of a multiple-colour LED package 30. The large jewel 14 receives ambient illumination externally from the article. In addition, the power supply is provided from a single low-voltage battery which has its voltage stepped up to the desired level. Also, the illumination control circuit is provided on two separate printed circuit boards rather than a single one as in the first embodiment. This provides the benefit that the boards can be arranged to minimise the space occupied by the circuit within the article of jewellery.

In FIG. 2 a control board 50 is shown in detail. The control board 50 has at its heart a PIC microprocessor 52 which is used to control the operation of the jewel illumination system 54. In this embodiment, the jewel illumination system 54 comprises a single LED package 56 containing red, green and blue LEDs 58. The control board 50 comprises a driver circuit 60 for supplying current to each of the red, green and blue LEDs 58 which are commoned at one side to the driver circuit 60. The other sides of the LEDs 58 are connected individually to the PIC microprocessor 52. Accordingly, the driver circuit can be relatively simple as control of the LED selection is carried out by the PIC microprocessor 52.

The PIC microprocessor 52 is a PIC 12C508-04SM device. This device has the ability to store a control program for sequentially pulsing the LEDs 58 to generate a corresponding light pulse from a pulsed LED 58. In addition, the PIC microprocessor 52 stores a digital program specifically designed to drive the LEDs 58 in a way such as to stimulate natural optical effects, such as natural sparkle and scintillation, and also to generate artificial optical effects. A detailed description of how to drive the LEDs 58 in such a way is given in our co-pending International Patent application WO-A-99/23906.

The PIC microprocessor 52 is connected to a power supply board 62 (see FIG. 3) which provides power lines 64 and control lines 66 providing user selection signals from the S-shaped metallic contacts 24.

Referring now to FIG. 3, the power supply board 62 is shown. The power supply board 62 houses a micro-electronic switching power supply 68 and an analogue condition sensing circuit 70. The micro-electronic switching power supply 68 is a low-power compact size MAX1678EUA device.

The power supply board 62 essentially takes power from a single 1.2 Volt Nickel Metal Hydride rechargeable battery 72 and, by use of the micro-electronic power supply 68, steps this voltage up to the 3.0 Volts. This voltage signal is then supplied to the control board 50 such that it can be used to operate the driver circuit 60 of the LEDs 58, and the PIC microprocessor 52.

The condition sensing circuit 70 functions to sense activity at the S-shaped contacts 24 and to generate appropriate control signals for the micro-electronic power supply 68 and the PIC microprocessor 52. In particular, the condition sensing circuit detects changes in resistance when a user places his or her finger (not shown) across the two S-shaped contacts 24 because a weak conductive link is formed between the contacts effectively altering the resistance therebetween. When the change in resistance has reached a threshold value, the condition sensing circuit generates an appropriate signal indicative of this. Such signals are transmitted to the PIC microprocessor 52 and used in the selection algorithms implemented there.

It is to be appreciated that the above described power supply board 62 and the microprocessor control board 50 could advantageously be used in the first embodiment without difficulty. In this case, only the single 1.2 Volt rechargeable battery 72 would be required rather than the two batteries 38 shown in FIGS. 1*b* and 1*c*, and a single LED package 30, 56 could be powered and controlled. However, it would also readily be possible to replace the PIC microprocessor 52 of FIG. 3 with a slightly larger PIC microprocessor or to adapt it to control and operate multiple LED packages 30, 32.

Figure 4A:
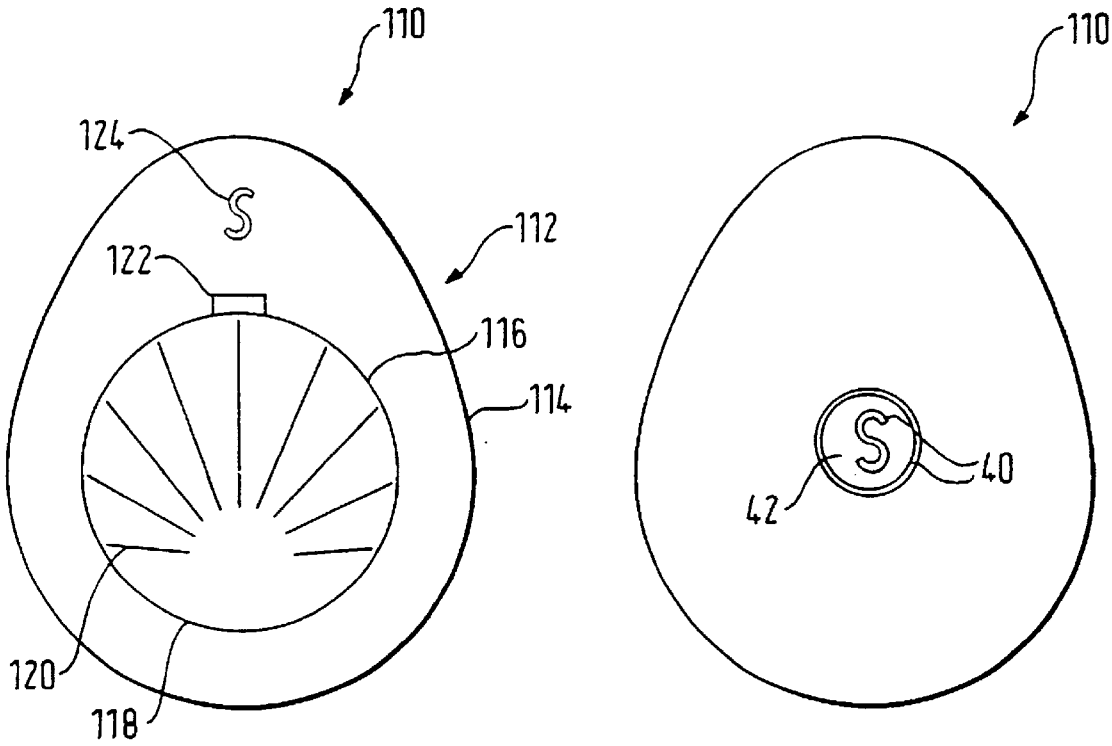
FIG. 4*a* is a front view of an article of jewellery incorporating a compound jewel of a third embodiment of the present invention.
Figure 4B:
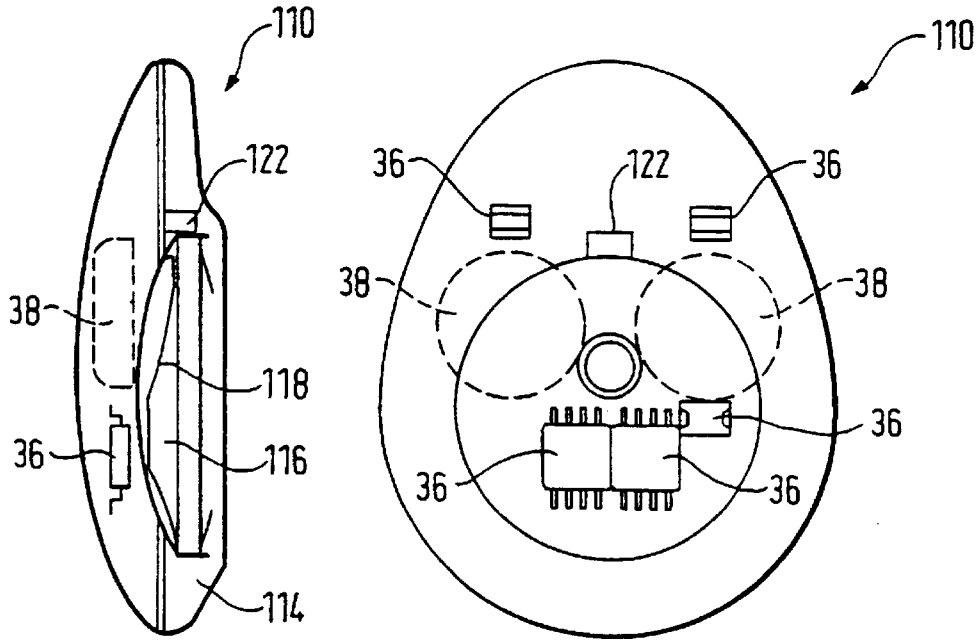
FIG. 4*b* is a set of sectional and non-sectional, rear and side views of the article of jewellery shown in FIG. 4*a*.

Referring now to FIGS. 4*a* and 4*b*, an article of jewellery 110 according to a third embodiment of the present invention is shown. The article of jewellery 110 incorporates a compound jewel 112 together with an illumination system. The article 110 is similar in many ways to the article of jewellery 10 described in the first embodiment and so for the sake of brevity, only the differences will be described hereinafter.

The article 110 is in the shape of an oval stone. The compound jewel 112 comprises a relatively large oval-shaped jewel 114 within which is provided a smaller round-shaped jewel 116. The small jewel 116 has a relative size to the large jewel 114 which is significantly greater than that of the small jewel 16 in the first embodiment. Accordingly, the hole 118 in the large jewel 114, for accommodating the small jewel 116, is correspondingly larger. Also, the small jewel 116 has formations 120 within it which together resemble the shape of an oyster.

The compound jewel 112 has a single illumination source (multiple-colour LED package) 122 for illuminating the small jewel 116. The large jewel 114 is not artificially illuminated and relies on ambient external light for its optical effects.

A pair of user input contacts 124 are provided in a different relative location as compared to the contacts 24 of the first embodiment. However, the function of these contacts 124 is the same.

Having described particular preferred embodiments of the present invention, it is to be appreciated that the embodiments in question are exemplary only and that variations and modifications such as will occur to those possessed of the appropriate knowledge and skills may be made without departure from the spirit and scope of the invention as set forth in the appended claims. For example, whilst the present invention has been described with a compound jewels having a single small jewel (PJ) set into a large jewel (SS), it must be appreciated that the present invention can be extended to a compound jewel having a plurality of small jewels mounted within a single large jewel. Also each of these smaller jewels could be arranged to have its own illumination system such that several Precious Jewels could be provided within the same Silver Sea.

What is claimed is:

1. An article of jewelry for generating an attractive composite optical effect, the article of jewelry comprising:

a compound jewel having a first portion and a second portion, the first and second portions having different optical properties and responding in visibly different ways to illumination; and a light source for artificially illuminating at least the first portion of the compound jewel, the compound jewel and light source being arranged to generate the composite optical effect from the combination of optical effects generated by the artificially illuminated first portion and from the second portion when the same is naturally or artificially illuminated.

2. An article of jewelry according to claim 1, wherein the light source is arranged to illuminate the second portion of the compound jewel.

3. An article of jewelry according to claim 1, further comprising a further light source arranged to artificially illuminate the second portion of the compound jewel.

4. An article of jewelry according to claim 3, further comprising a controller for controlling the light source or further light source to cause it to emit light pulses wherein the operation of the light source and the further light source are independently controllable by the controller to provide two independently controllable light sources.

5. An article of jewelry according to claim 1, wherein the light source comprises a low-power consumption light emitting diode.

6. An article of jewelry according to claim 5, wherein the light source comprises a multi-color light emitting diode package.

7. An article of jewelry according to claim 1, further comprising a controller for controlling the light source to cause it to emit light pulses.

8. An article of jewelry according to claim 7, wherein the controller is arranged to cause the light source to emit light pulses of variable intensity.

9. An article of jewelry according to claim 7, wherein the controller is arranged to cause the light source to emit a series of light pulses in which each light pulse has a controllably variable duration.

10. An article of jewelry according to claim 7, wherein the controller performs an algorithm to vary the pattern, amplitude, color and/or duration of the light emission.

11. An article of jewelry according to claim 7, wherein the controller is arranged to cause contrasting optical effects to be generated in the first and second portions of the compound jewel.

12. An article of jewelry according to claim 7, further comprising a touch-sensitive input pad for selecting the mode of operation of the light source by the controller.

13. An article of jewelry according to claim 1, wherein the signals received from a user via the touch-sensitive input pad can be used by the controller to select a color range of illumination for the first or second portions of the compound jewel.

14. An article of jewelry according to claim 8, wherein the controller is arranged to cause the light source to emit light pulses in which the light output intensity is controllably varied along the duration of each pulse.

15. An article of jewelry according to claim 14, wherein the light output intensity is decreased along the duration of each light output pulse.

16. An article of jewelry according to claim 1, wherein the light source is positioned in relation to the portions of the compound jewel such that the light emitted from the light source is not directly visible from the front of the compound jewel but is internally reflected and/or refracted in at least one portion of the jewel at least once before reaching the eye of a viewer.

17. An article of jewelry according to claim 1, wherein the compound jewel includes at least one of a precious stone, semi-precious stone and imitation thereof.

18. An article of jewelry according to claim 1, wherein the first and second portions of the compound jewel are formed of different materials to provide different light transmission, reflection or refraction characteristics.

19. An article of jewelry according to claim 1, further comprising a support in which the compound jewel is mounted.

20. An article of jewelry according to claim 1, wherein the first portion of the compound jewel has a multi-faceted optical surface and second portion which has a continuous planar or gently curving optical surface.

21. An article of jewelry according to claim 1, further comprising a low-voltage battery and a microelectronic step-up switching power supply.

22. An article of jewelry according to claim 21, wherein the battery comprises a rechargeable battery.

23. An article of jewelry according to claim 22, further comprising charging means for recharging the battery.

24. An article of jewelry according to claim 23, wherein the charging means comprises charging terminals provided as part of a fixing screw mounting.

25. A combination of an article according to claim 1, and a charging circuit external to said article, said external charging circuit being connectable to a permanent mains power supply.

26. An article of clothing incorporating one or more articles of jewelry according to claim 1.

27. An article of jewelry according to claim 1, wherein the further light source is positioned in relation to the portions of the compound jewel such that the light emitted from the further light source is not directly visible from the front of the compound jewel but is internally reflected and/or refracted in at least one portion of the jewel at least once before reaching the eye of a viewer.

28. A method of generating an attractive composite optical effect in an article of jewelry comprising a compound jewel with a first portion and a second portion, the first and second portions having different optical properties and responding in visibly different ways to illumination, the method comprising:

artificially illuminating the first portion of the compound jewel;

artificially or naturally illuminating the second portion of the compound jewel; and permitting combination of optical effects generated by the illumination of the first portion and the second portion to thereby provide the composite optical effect.

29. A method according to claim 28, wherein the step of artificially or naturally illuminating a second portion of the compound jewel comprises artificially illuminating the second portion independently of the first portion to provide different illumination of the first and second portions.

30. An article of jewelry for generating an attractive composite optical effect, the article of jewelry comprising:

a compound jewel having a first portion and a second portion, the first and second portions having different optical properties and responding in visibly different ways to illumination; and a light source for artificially illuminating at least the first portion of the compound jewel, the compound jewel and light source being arranged to generate the composite optical effect from the combination of optical effects generated by the artificially illuminated first portion and from the second portion when the same is naturally or artificially illuminated; and a controller for controlling the light source to cause it to emit light pulses wherein the controller is arranged to cause the light source to emit light pulses of variable intensity.

31. An article of jewelry for generating an attractive composite optical effect, the article of jewelry comprising:

a compound jewel having a first portion and a second portion, the first and second portions having different optical properties and responding in visibly different ways to illumination; and a light source for artificially illuminating at least the first portion of the compound jewel, the compound jewel and light source being arranged to generate the composite optical effect from the combination of optical effects generated by the artificially illuminated first portion and from the second portion when the same is naturally or artificially illuminated; and a controller for controlling the light source to cause it to emit light pulses wherein the controller is arranged to cause the light source to emit a series of light pulses in which each light pulse has a controllably variable duration.

* * * * *